US010136704B2

(12) United States Patent
Garnighian et al.

(10) Patent No.: US 10,136,704 B2
(45) Date of Patent: Nov. 27, 2018

(54) FABRIC FASTENERS

(71) Applicant: PINION PINS, LLC, Durham, NC (US)

(72) Inventors: Grania Viorela Garnighian, Tampa, FL (US); Raffi Nicholas Garnighian, Tampa, FL (US)

(73) Assignee: Pinion Pins, LLC, Durham, NC (US)

( * ) Notice: Subject to any disclaimer, the term of this patent is extended or adjusted under 35 U.S.C. 154(b) by 232 days.

(21) Appl. No.: 14/572,006

(22) Filed: Dec. 16, 2014

(65) Prior Publication Data

US 2015/0181982 A1 Jul. 2, 2015

Related U.S. Application Data

(60) Provisional application No. 61/922,143, filed on Dec. 31, 2013.

(51) Int. Cl.

| | |
|---|---|
| ***A44B 1/28*** | (2006.01) |
| ***A44B 1/06*** | (2006.01) |
| ***F16B 19/00*** | (2006.01) |

(52) U.S. Cl.

CPC ..... *A44B 1/28* (2013.01); *A44B 1/06* (2013.01); *F16B 19/00* (2013.01); *A44D 2203/00* (2013.01); *Y10T 29/4997* (2015.01)

(58) Field of Classification Search

CPC ..... A44B 1/28; A44B 1/06; A44D 2203/00; F16B 19/00; Y10T 29/49947; Y10T 29/4614

See application file for complete search history.

(56) References Cited

U.S. PATENT DOCUMENTS

| | | | | | |
|---|---|---|---|---|---|
| 1,053,883 | A | * | 2/1913 | Sheppard | A44B 9/10 24/706.8 |
| 1,472,681 | A | * | 10/1923 | Roy | A44B 9/10 24/706.8 |
| 1,760,346 | A | | 5/1930 | Correa | |
| 2,354,638 | A | * | 7/1944 | Okerholm | A44B 1/28 24/706.8 |
| 2,749,588 | A | * | 6/1956 | Pliszczak | A44B 1/28 24/104 |
| 3,141,216 | A | | 7/1964 | Brett | |

(Continued)

FOREIGN PATENT DOCUMENTS

| | | |
|---|---|---|
| EP | 0026968 | 4/1981 |
| EP | 1090569 | 4/2001 |

(Continued)

OTHER PUBLICATIONS

Handy Accents, website www.handyaccents.com/Handy_comforter_clips_prod.html.

(Continued)

*Primary Examiner* — Victor D Batson
*Assistant Examiner* — Matthew J Sullivan
(74) *Attorney, Agent, or Firm* — Thomas J. Nikolai; Nikolai & Mersereau, P.A.

(57) ABSTRACT

A coupling for securing fabric items includes a pin assembly which has a head and a shaft. The shaft passes through the fabric items. A catch is then mated with the shaft such that the fabric items are sandwiched between the head and the catch. A magnetic release member is employed when it becomes necessary to decouple the catch from the shaft.

20 Claims, 11 Drawing Sheets

(56) References Cited

U.S. PATENT DOCUMENTS

| | | | | |
|---|---|---|---|---|
| 3,858,280 | A * | 1/1975 | Martens | E05B 73/0017 24/108 |
| 3,911,534 | A * | 10/1975 | Martens | E05B 73/00 24/704.1 |
| 3,947,930 | A * | 4/1976 | Martens | E05B 73/0017 24/704.2 |
| 4,280,256 | A * | 7/1981 | de Jong | E05B 73/0017 24/110 |
| 4,523,356 | A * | 6/1985 | Charlot, Jr. | E05B 73/0017 24/706.8 |
| 4,903,383 | A * | 2/1990 | Gartshore | E05B 73/0017 24/706.6 |
| 5,208,580 | A | 5/1993 | Crossfield | |
| 5,732,451 | A | 3/1998 | Mars | |
| 6,481,585 | B1 | 11/2002 | Cloughton | |
| 7,120,972 | B2 | 10/2006 | O'Banion | |
| 8,117,874 | B2 * | 2/2012 | McKeown | E05B 73/0017 24/704.1 |
| 8,424,174 | B2 * | 4/2013 | Kikunaga | A44B 9/08 24/706.5 |
| 8,464,408 | B2 * | 6/2013 | Hazzard | F16B 12/24 24/706.5 |
| 9,107,464 | B2 * | 8/2015 | Tom | A42B 3/0473 |
| 2006/0070411 | A1 | 4/2006 | Ho et al. | |
| 2006/0208908 | A1 | 9/2006 | Skjellerup et al. | |
| 2008/0050201 | A1 * | 2/2008 | Valade | E05B 73/0017 411/455 |
| 2011/0314605 | A1 | 12/2011 | Deguchi | |
| 2012/0125046 | A1 | 5/2012 | Vander Wal et al. | |

FOREIGN PATENT DOCUMENTS

| | | |
|---|---|---|
| EP | 2059151 | 11/2011 |
| EP | 2342995 | 7/2013 |
| WO | WO2012135891 | 10/2012 |

OTHER PUBLICATIONS

Handy Accents, website www.handyaccents.com.

Handy Accents, website www.handyaccents.com/Handy_Accents_Clips.html.

* cited by examiner

FABRIC FASTENERS

CROSS-REFERENCED TO RELATED APPLICATIONS

This application is a non-provisional application of Application No. 61/922,143, filed Dec. 31, 2013 and claims priority from that application which is also deemed incorporated by reference in its entirety in this application.

STATEMENT REGARDING FEDERALLY SPONSORED RESEARCH OR DEVELOPMENT

Not applicable

BACKGROUND OF THE INVENTION

I. Field of the Invention

The present invention relates to fabric fasteners such as those used to secure draperies, furniture covers, cushion covers, towels, bedding and the like. More specifically, the present invention provides fasteners which are aesthetically acceptable, do not damage fabrics with which the fasteners are employed, and which are highly effective to secure fabric items in place.

II. Related Art

One problem well-known to homeowners and hotel, staff members is the difficulty associated with retaining a comforter in place inside a duvet cover. The comforter and duvet cover will move relative to each other making it difficult to make the bed on which the comforter and duvet cover are employed.

Various attempts have been made to address this problem. For example, ribbons have been sewn to the inside of the duvet covers at the corners. These ribbons may be used to tie the corresponding corners of the comforter and duvet cover together. This is not an easy task because it often requires turning the duvet cover inside out to perform the task of tying the ribbons. Also, over a relatively short period of time the ribbons tend to become untied requiring the laborious tying process to be repeated. To launder the duvet cover or comforter, the ribbons must, of course, be untied to decouple the duvet cover from the comforter. The tying operation must be repeated once laundering is completed. Other fasteners have been developed to address this problem in other ways, but these tend to be unacceptable from an aesthetic standpoint or difficult to use.

Wedding planners use fabrics in many different ways to decorate wedding and reception venues. Fabrics are not only used to clothe the wedding party, but also as draperies, table linens, chair and seat covers, canopies, swags and the like. Rooms are often decorated differently for each wedding held. There is a real need for devices which are decorative and may be quickly and easily employed to shape and securely retain such items in place without damaging the fabric or items to which the fabric is attached. This same need exists with respect to home and other commercial decorating efforts.

Outdoor activities for example, camping and ice fishing) often involve the use of tents or other temporary shelters made of tarps or other fabrics attached to a frame. Advantages can be derived by employing quick, inexpensive, easy-to-carry and simple attachment devices to couple the fabric to the frame without damage to the fabric.

SUMMARY OF THE INVENTION

To address problems discussed above and other problems associated with securing fabric items to each other or in place, a unique and novel fabric fastener (i.e., fabric coupling kit) is provided. Each fabric coupling kit includes at least one pin assembly which cooperates with a catch assembly. The kit also includes a release member.

The pin assembly comprises a tack having a head and a shaft projecting from the head. The head may be decorated in any number of ways such as to match or accent the fabric with which the fabric coupling kit is used. Further, and for additional security, the pin assembly may also include a flange member through which the shaft passes. The flange is intended to engage the head of the tack and the fabric with which the kit is employed to provide a larger area of contact with the fabric than the tack's head could provide on its own. The flange member may be decorated as desired or made transparent so the pattern and color of the fabric are visible through the flange.

The catch assembly comprises a first outer housing surrounding a chamber. The housing includes an engagement member having an engagement surface and a collar surrounding an opening to the chamber. The outer housing also includes a cover. A hole adapted to receive the shaft of the tack is centered in the cover and provides a path through the cover into the chamber. The engagement member is formed by a wall having an inside surface and an outside surface which are each tapered from the collar to a point.

Located inside the chamber of the outer housing of the catch assembly is a catch. The catch includes an inner housing comprising a base having a bottom, tapered side walls and an open top. The inner housing also includes a cover having a tapered side wall and a top. A hole is provided through the top of the cover for receiving the shaft of the tack. The base and cover form an inner chamber.

Positioned inside the inner chamber is a pinching element comprising a frame. The frame includes opposing end walls and a longitudinal opening for receiving the shaft of the tack through each of the end walls. The frame also includes a side wall providing a spring collar at one end and including three side openings. The pinching element further includes three ball hearings. The ball bearings are positioned within the three side openings and are able to move back and forth as discussed further below. The pinching element further comprises a spring having one end receiving within the spring collar. The other end of the spring engages the bottom of the base of the inner housing when the catch assembly is assembled.

More specifically, the spring biases the pinching element away from the base and toward the top of the cover of the catch. The tapered side wall of the cover of the catch imparts an inward pinching motion against the ball hearings forcing each toward the center of the frame. This pinching force is sufficient to grip and hold the shaft of the tack when mated with the catch assembly and, more precisely, the frame of the pinching element.

As such, the pin assembly is quickly and easily coupled and secured to the catch assembly by passing the free end of the shaft of the tack (i) through the opening extending through the cover of the outer housing of the catch assembly; (ii) through the opening extending through the cover of the catch; (iii) through the spring of the pinching element; (iv) through the spring collar of the frame of the pinching element; and (v) through the longitudinal opening of the frame of the pinching element and between the three ball bearings. The spring, the frame and the tapered inner wall of the cover of the inner housing cooperate to press the ball bearings against the shaft of the tack with sufficient force to prevent retraction of the tack relative to the catch assembly.

From time to time, it will become necessary to separate the pin assembly from the catch assembly. Thus, a release member is also provided. The release member includes a cylindrical tube having at least one open end. The diameter of the open end of the tube is such that the tapered end of the engagement member just fits within the open end of the cylindrical tube. Recessed within the tube is one or more magnets. A single 3500 Tesla neodymium magnet is suitable for use. Such a magnet creates a magnetic force which, when properly aligned with the frame, is sufficient to overcome the force of the spring and retract the frame from the top of the cover of the catch. Specifically, when the tapered end of the engagement member is mated with the open end of the tube, the frame of the engagement member is properly oriented with the magnetic field supplied by the magnet(s) and the sufficient magnetic force is applied to the frame of the catch assembly to overcome the force of the spring and move the frame toward the magnet(s). The taper of the cover of the catch no longer pushes the ball bearings tight against the shaft of the pin assembly after the frame is moved by this magnetic force. The pin assembly may therefore be pulled free of the catch assembly. The fact that the release assembly has a recessed magnet and mates in only one way with the catch assembly ensures the magnetic force is applied along the correct axis to permit quick and easy decoupling.

Those skilled in the art will recognize that in many situations, multiple pin assemblies and catch assemblies may be employed to retain fabric items in place. Only one release member is required to quickly and easily decouple the pin assemblies from the catch assemblies when so desired.

BRIEF DESCRIPTION OF THE DRAWINGS

The foregoing features, objects and advantages of the invention will become apparent to those skilled in the art from the following detailed description and with reference to the following drawings in which like numerals and the several views refer to corresponding parts.

DETAILED DESCRIPTION

Figure 1:
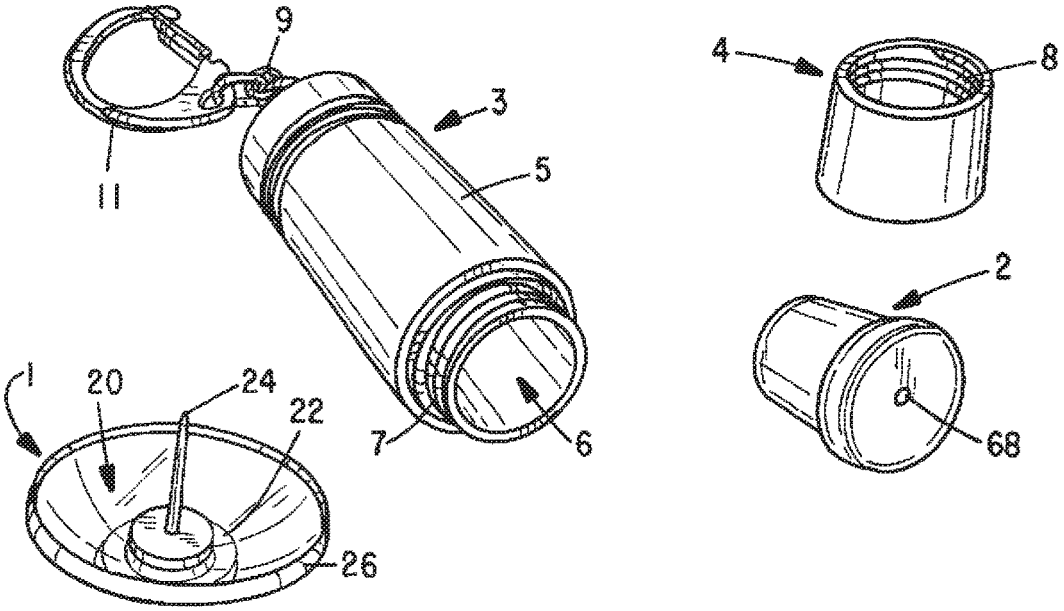
FIG. 1 is a perspective view showing a pin assembly, a catch assembly and a release member.

This description of the preferred embodiment is intended to be read in connection with the accompanying drawings, which are to be considered part of the entire written description of this invention. In the description, relative terms such as "lower", "upper", "horizontal", "vertical", "above", "below", "up", "down", "top" and "bottom", as well as derivative thereof (e.g., "horizontally", "downwardly", "upwardly", etc.) should be construed to refer to the orientation as then described or as shown in the drawings under discussion. These relative terms are for convenience of description and do not require that the apparatus be constructed or operated in a particular orientation. Terms such as "connected", "connecting", "attached", "attaching", "joined", and "joining" are used interchangeably and refer to one structure or surface being secured to another structure or surface or integrally fabricated in one piece unless expressly described otherwise.

Figure 2:
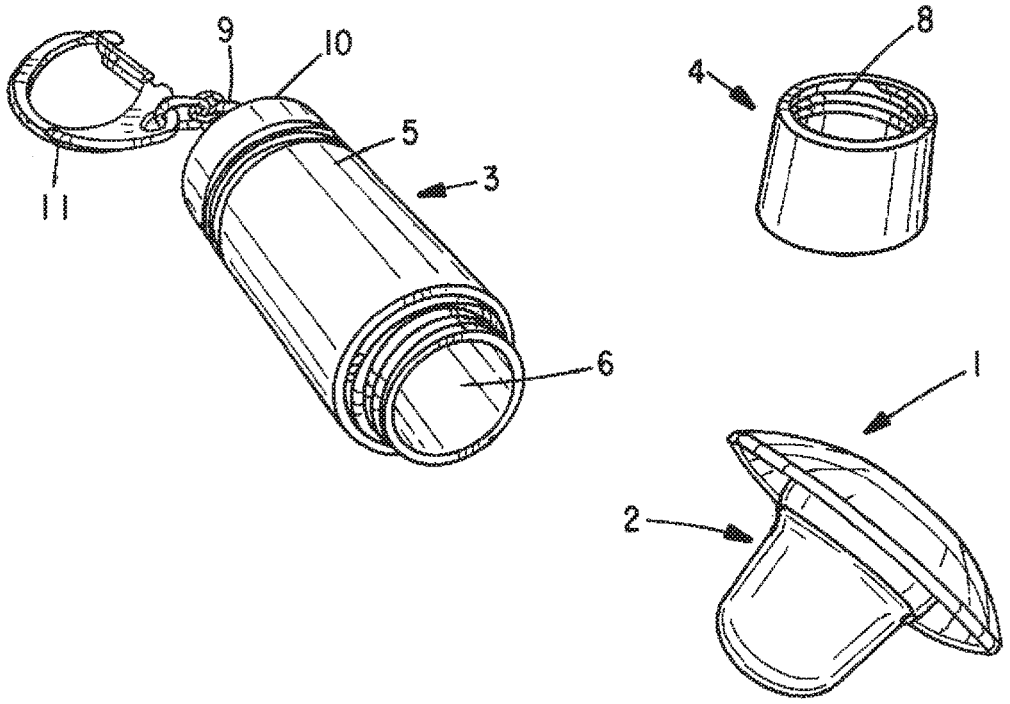
FIG. 2 is a perspective view showing the pin assembly and catch assembly of FIG. 1 coupled together and also showing the release member.
Figure 3:
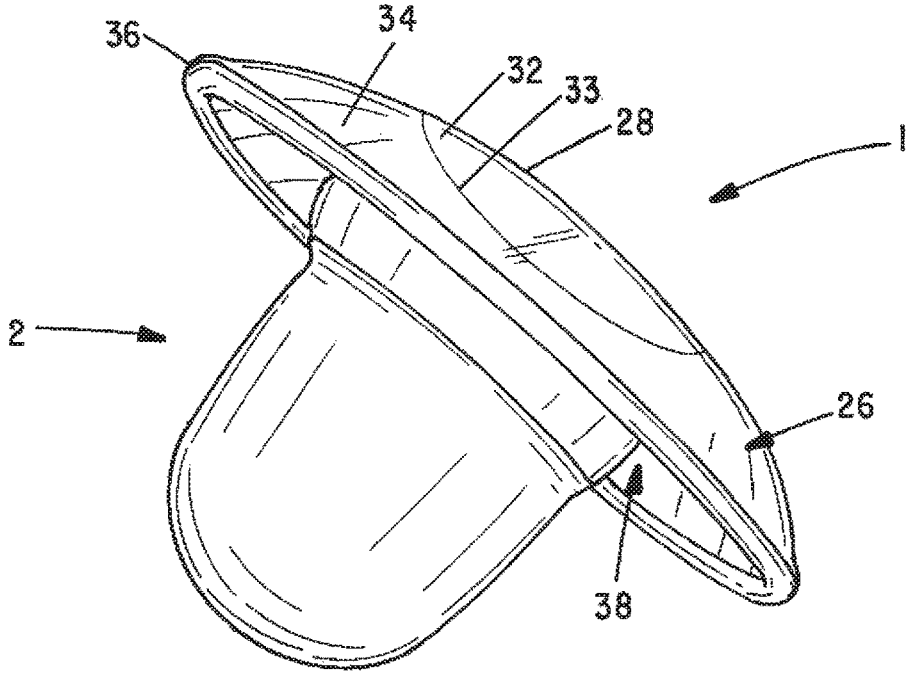
FIG. 3 is a perspective view of the in assembly and catch assembly of FIG. 1 coupled together.
Figure 3A:
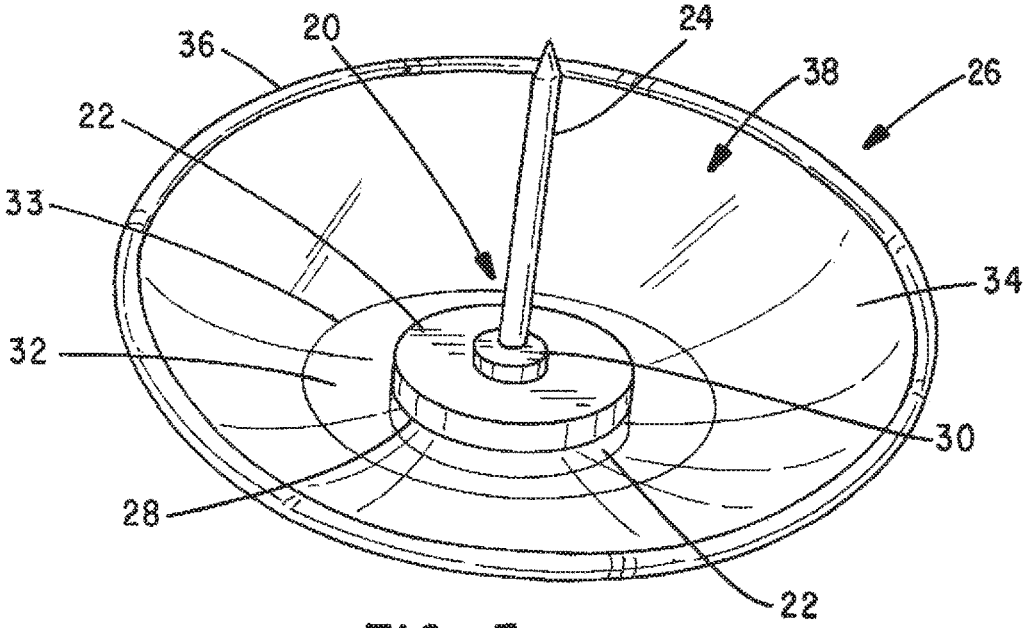
FIG. 3*a* is a perspective view of the pin assembly of FIG. 1.
Figure 5:
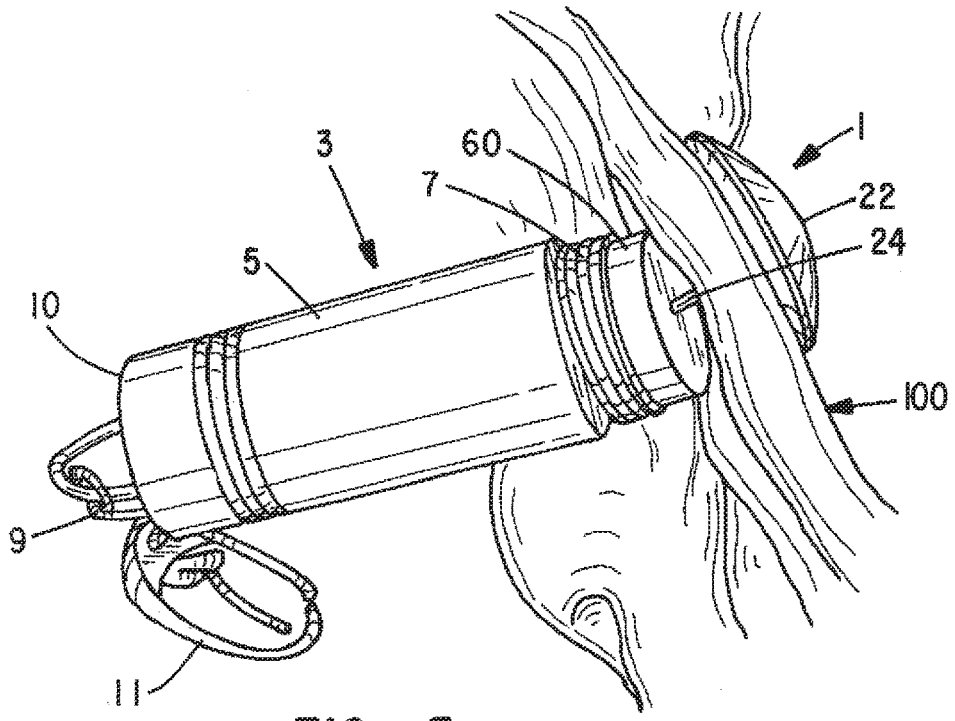
FIGS. 5 and 6 are perspective views showing how the catch assembly is coupled to the release member to permit decoupling of the pin assembly from the catch assembly.
Figure 6:
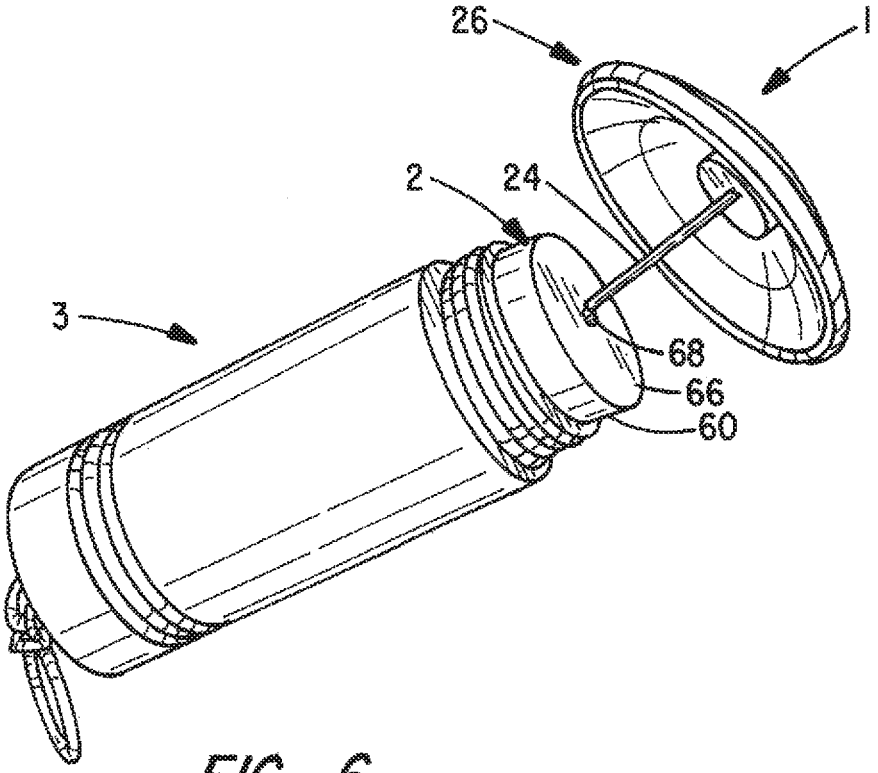
Figure 7:
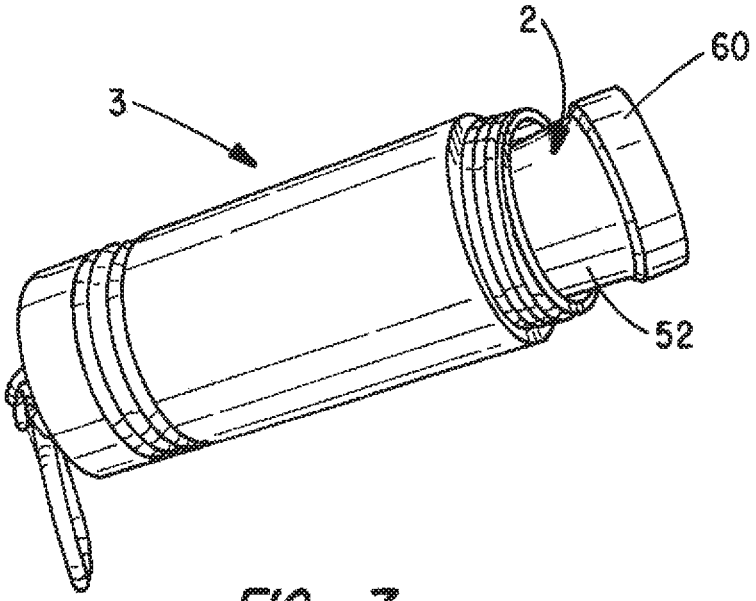
FIG. 7 is a perspective view showing removal of the catch assembly from the release member after the pin assembly has been decoupled from the catch assembly.
Figure 8:
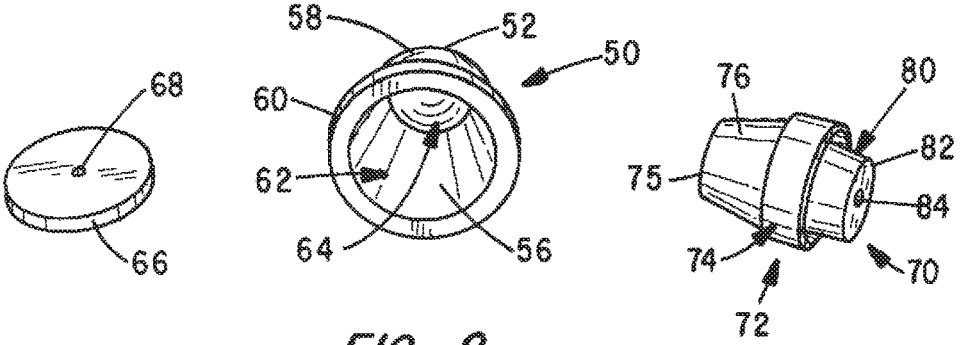
FIG. 8 is a perspective view of the components of the outer housing of the catch assembly together with the catch of the catch assembly.
Figure 9:
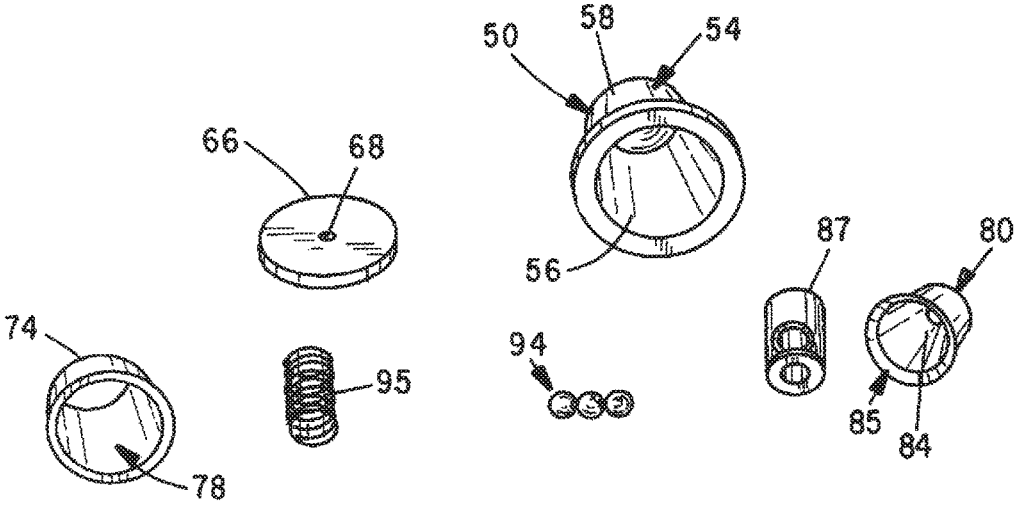
FIGS. 9 and 10 are perspective views showing each of the components of the catch assembly.
Figure 10:
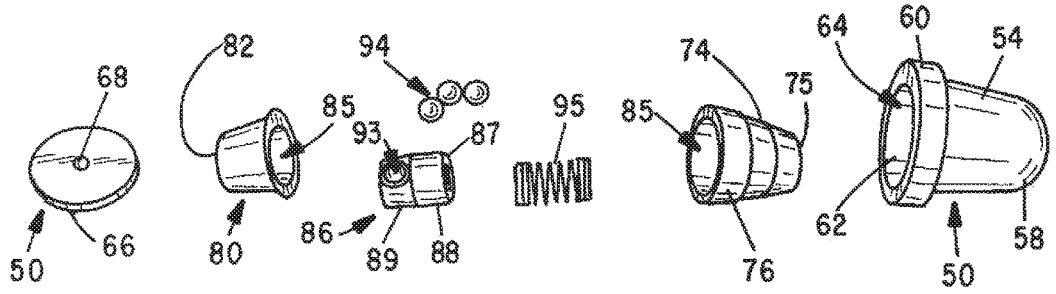

As illustrated in FIGS. 1-3, a fabric fastener may be provided which includes a pin assembly 1, a catch assembly 2 and a release member 3. A cap 4 may also be provided as part of the release member 3. The pin assembly 1 is designed to be coupled to the catch assembly 2 to secure multiple sections of fabric together as illustrated in FIGS. 2-3 and 19-22. These sections may be part of a single larger item as illustrated in FIG. 5. Alternatively, these sections may be part of separate items as illustrated in FIGS. 19-22. The release member 3 is employed, to permit detachment of the catch assembly 2 from the pin assembly 1.

The release member 3 comprises a cylindrical wall 5 open at one end 6. The open end 6 may have threads which mesh with corresponding threads 8 on the cap 4 so the cap may be employed to close the open end 6 when the release member 3 is not in use. FIGS. 1, 2 and 5 also show a chain 9 secured to the closed end 10 of the release member 3 and a clip 11 coupled to the chain 9. This clip may be employed to fasten the release member 3 to an article of clothing worn by the user, a key chain carried by the user or some other item such that the release member 3 is always at hand and available for use.

Figure 4:
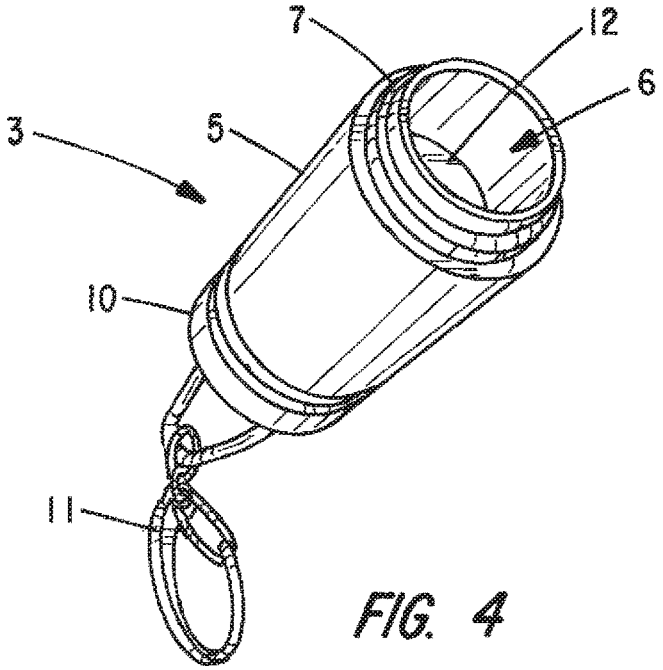
FIG. 4 is a perspective view of the release member of FIG. 1.

The release member 3 also includes at least one magnet 12 which is best seen in FIG. 4. The magnet 12 is recessed from the open end 6 of the release member. The magnet may be a 3500 Tesla neodymium magnet. Such a magnet creates a strong enough magnetic force to enable decoupling of the pin assembly 1 and catch assembly 2.

A variety of pin assemblies 1 may be employed. As should be evident from FIGS. 12-18, various decorative designs may also be employed. Likewise, various materials may be employed. All such pin assemblies have certain features in common. Specifically, all include a tack 20 comprising a head 22 and elongate shaft 24 extending from the head 22. As illustrated in FIGS. 1-3*a* and 5-6, the pin assembly 1 may also include a flange member 26. As shown in FIGS. 12, 15-16 and 18, various ornaments 23 may be coupled to the head 22 of tack 20.

As illustrated in FIGS. 1-3*a* and 5-6, flange member 26 may be made of a transparent material. Thus, any immediately underlying fabric layer (e.g. layer 102 of fabric 100 in FIG. 5) can be seen through the flange member 26. The flange member 26 has an umbrella shape. More specifically, the bottom of head 22 of tack 20 engages a central flat portion 28 of the flange member 26. The central flat portion 28 has a hole 30 passing through the center thereof. This hole 30 permits the shaft 24 of tack 20 to be extended through the flange 26. The flange 26 may also have a short frusto-conical section 32 surrounding and extending outwardly from the perimeter of the center flat portion 28 toward its outer boundary 33 such that the head 22 of tack 20 is recessed. A taller frusto-conical section 34 may then extend from the aforementioned boundary 33 back toward the outer edge 36 of the flange 26 to provide the flange 26 with a recessed bottom surface 38. By providing the flange 26, and in particular a flange 26 having these features, a larger area of engagement is provided between the fabric 100 and the pin assembly 1 than if only the tack 20 were employed since the flange 26 is broader and more spacious than the head 22 of tack 20.

The catch assembly 2 has a first or outer housing 50 comprising an engagement member 52 having a tapered engagement wall 54 having an interior engagement surface 56 and exterior engagement surface 58. The engagement member 52 also has a collar 60 at one end of and extending outwardly from, the widest portion of the tapered engagement wall 54. The collar 60 encircles an opening 62 into a chamber 64 within the tapered engagement wall. The outer housing 50 also includes a cap or cover 66 which engages the collar 60 to enclose the chamber 64. A hole 68 is provided through the cap or cover 66. Hole 68 is sized to receive the elongate shaft 24 of the pin assembly 1. The tapered engagement wall 54 is of a size and shape which permits the tapered wall 54 to be received within the open end 6 of the release member 3 when the cap 4 has been removed. The collar 60 is sized to engage the end of the cylindrical wall 5 of release member 3 surrounding opening 6. This serves to properly orient the contents of the chamber 64 with the magnetic field supplied by magnet 12.

The contents of chamber 64 include a catch 70. The catch 70 includes a second inner housing 72 comprising a base 74. The base 74 has a bottom 75, a tapered side wall 76 and an open top 78. The inner housing 72 also includes a cover 80 having a top 82 with a hole 84. Hole 84 is aligned with hole 68 in the cap or cover 66 of outer housing 50 for receiving the elongate shaft 24 of the tack 20. The cover 80 engages the base 74 to secure the cover 80 to the base 74 such that the base 74 and cover 80 form an inner chamber 85. The side wall of the cover is also tapered.

Positioned inside inner chamber 85 is a pinching element 86. Pinching element 86 comprises a frame member 87 having opposing end walls 88 and 89. A longitudinal opening 90 extends through the frame 87 and the two end walls 88 and 89. This longitudinal opening 90 is aligned with holes 68 and 84 and is sized to receive the elongate shaft 24 of the pin assembly 1.

The frame member 87 also includes a side wall 91 providing a spring collar 92 at one end extending beyond end wall 88. Three side openings 93 extend through the side wall of the frame 87. A separate central axis extending from the longitudinal axis through any of the side openings 93 forms an angle of approximately 120° with each of the central axes of the other two openings. Pinching element 86 also includes three ball bearings 94. A separate ball bearing 94 is positioned within each of the side openings 93 and is sized relative to the opening 93 in which it is located so the ball bearing 94 can move along the central axis of the side opening 93. Completing the pinching element 86 is a spring 95 positioned in the spring collar 92 such that one end of the spring 95 engages wall 88 of the frame member 87. The other end of spring 95 engages bottom 75 of base 74. The spring 95 therefore applies a spring force against the frame member 87 which biases the frame member 87 away from the bottom 75 of base 74 and toward the top of the cover 80. Since the side wall of the cover 80 is tapered, engagement of the ball bearings 94 with the side wall of cover 80 forces the ball bearings along the central axes of the three side openings 93 toward each other and longitudinal opening 90.

Figure 11:
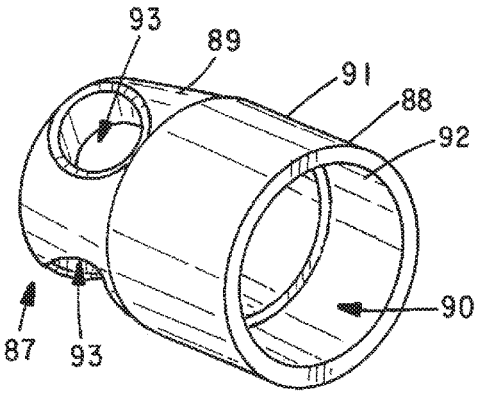
FIG. 11 is a perspective view of the frame of the catch.
Figure 11A:
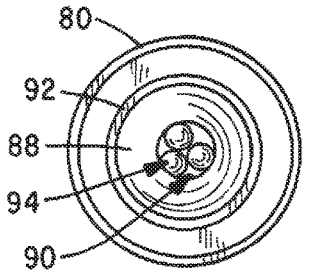
FIG. 11*a* is an end view showing components of the catch in assembled relation.
Figure 12:
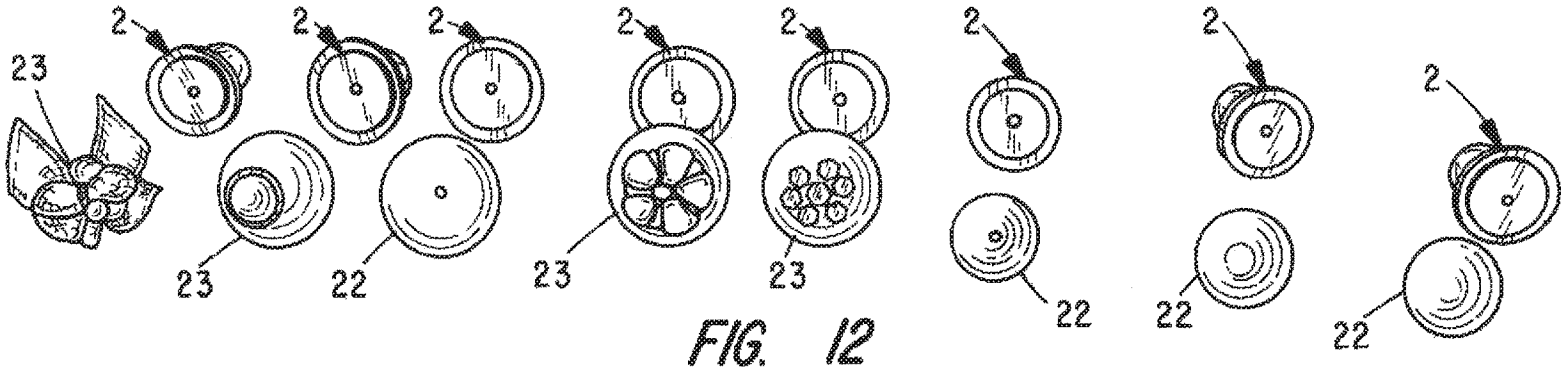
FIG. 12 is a perspective view showing a selection of pin assemblies having different ornamentation together with associated catch assemblies.
Figure 14:
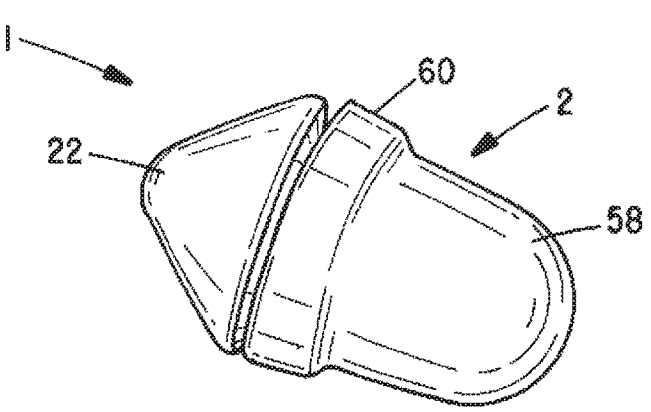
FIGS. 13-17 are perspective views showing different ornamental pin assemblies coupled to catch assemblies.
Figure 13:
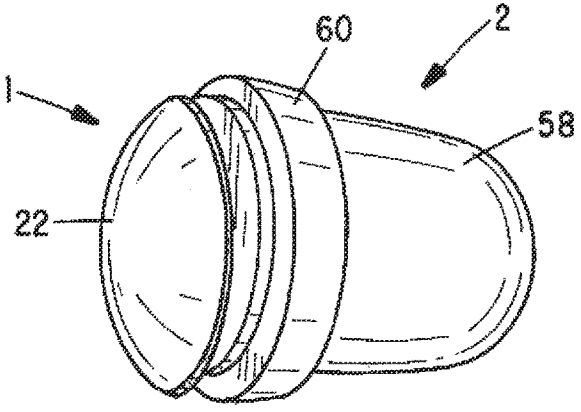
Figure 15:
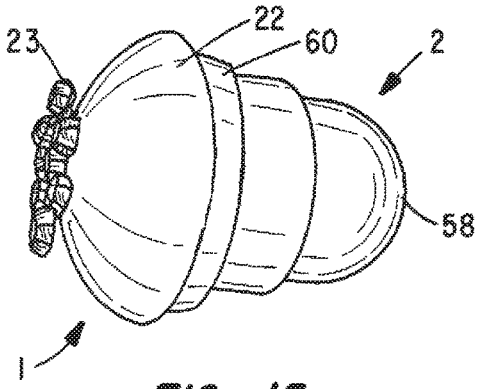
Figure 16:
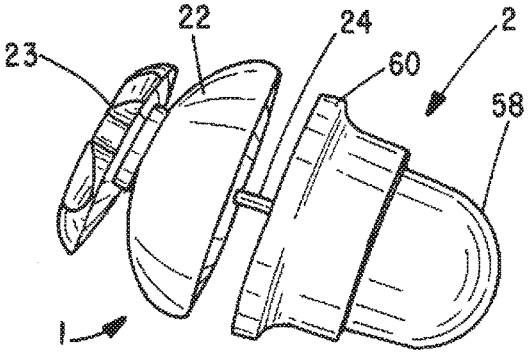
Figure 17:
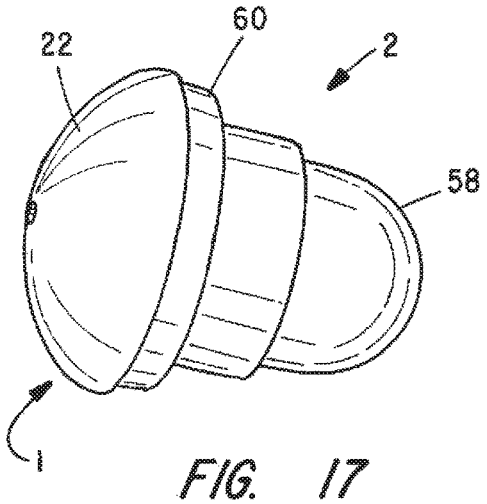
Figure 18:
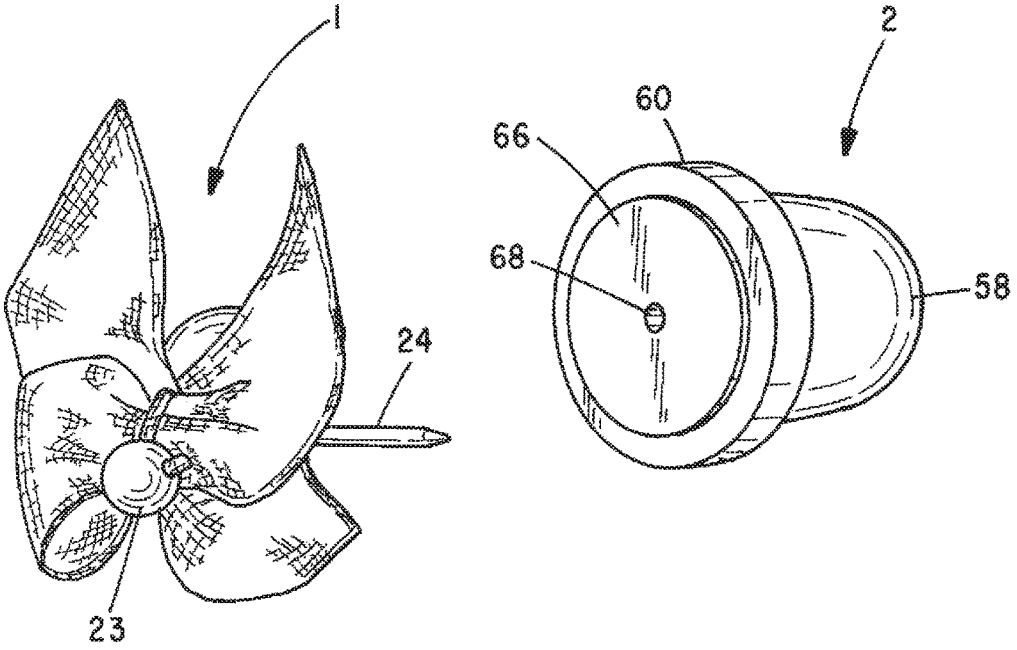
FIG. 18 is a perspective view showing a decorated pin assembly together with a catch assembly.
Figure 19:
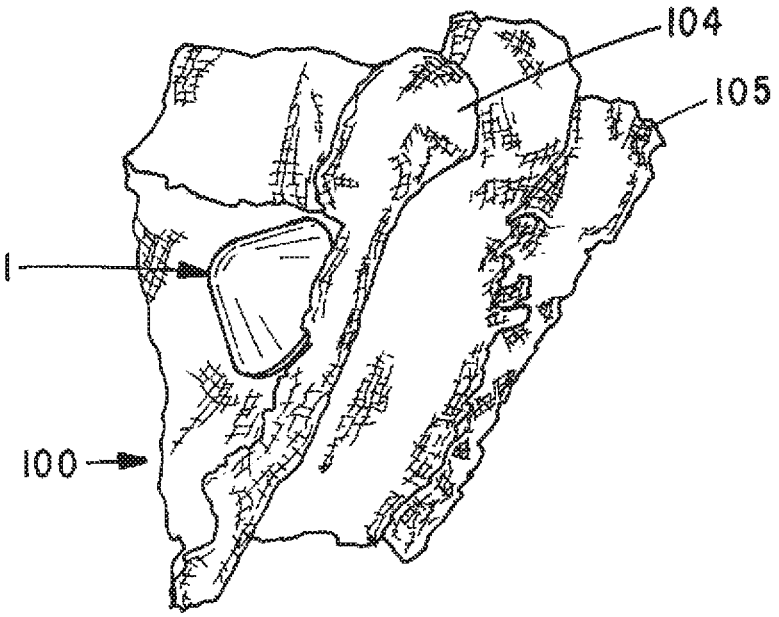
FIGS. 19-22 are perspective views showing how a pin assembly can be employed together with a catch assembly to couple the corners of two fabric pieces together.
Figure 20:
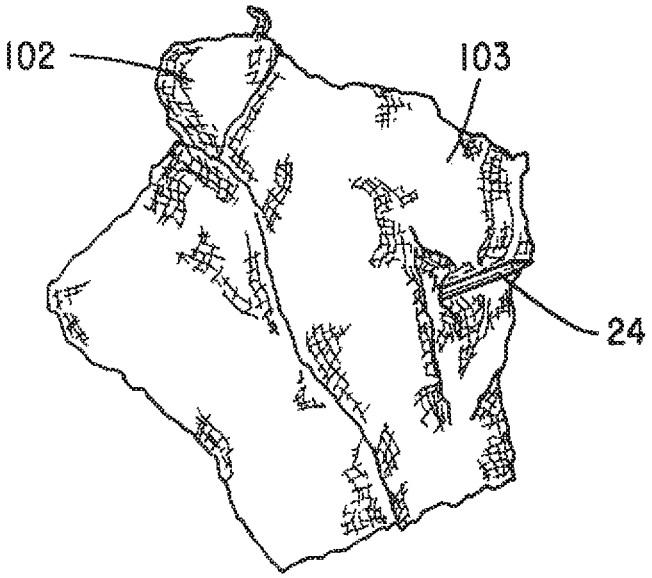
Figure 21:
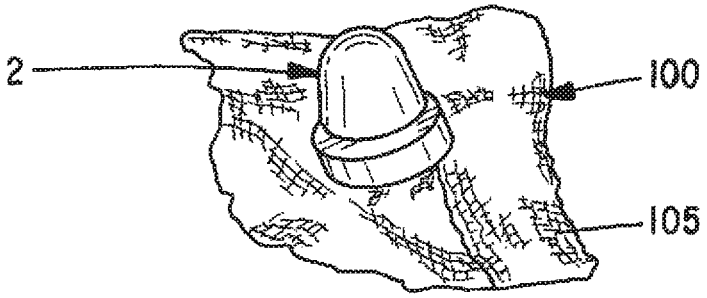
Figure 22:
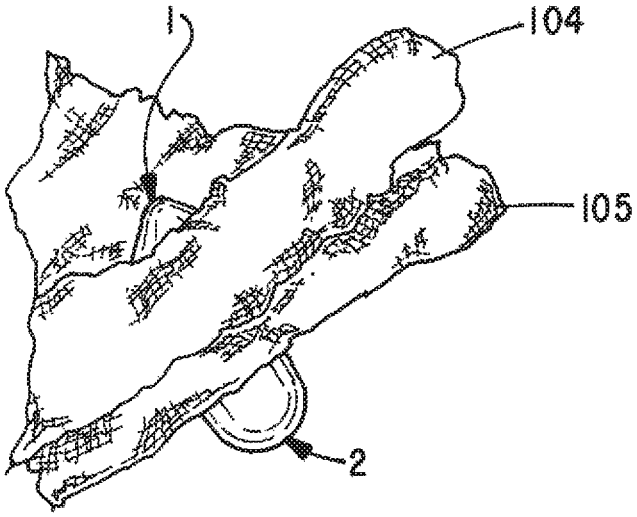

FIG. 11*a* shows various elements of the catch in assembled relation. These include the tapered cover 80 surrounding the pinching element 86. More specifically, the end wall 88, longitudinal opening 90, and the spring collar 92 of the frame are visible in FIG. 11*a*. Visible through the longitudinal opening 90 are the three ball bearings 94 of the pinching element 86. The ball bearings 94 cooperate with the tapered side wall of the cover 80, the frame member 87 and the spring 95, one end of which resides in the spring collar 92, to pinch the elongate shaft 24 when it resides (extends through) the longitudinal opening of frame member 87 to fasten the pin assembly 1 to the catch assembly 2.

More specifically, the pin assembly 1 and catch assembly 2 are coupled and locked together by inserting the elongate shaft. 24 (i) through the hole 68 in the cover 66 of the outer housing 50; (ii) through the hole 84 in the cover 80 of the inner housing 72; (iii) through the spring 95; (iv) through the spring collar 92; (v) through the longitudinal opening 90 of the frame 87 of the pinching element 86; and (vi) between the three ball bearings 94 of the pinching element 86. The spring 95 pushes the frame 87 further into and toward the top of the tapered cap 80. This, in turn, causes the interior wall of the tapered cap 80 to force the ball bearings 94 against the elongate shaft 24 thereby pinching the shaft 24 so the shaft 24 cannot be retracted from the catch assembly 2.

When a user wishes to decouple the catch assembly 2 and the pin assembly 1, the engagement member 52 of the catch assembly's outer housing 50 is mated with the open end 6 of the release member 3. This serves to properly orient the frame member 87 with the magnetic field generated by the magnet or magnets 12. The magnet(s) 12 then acts on the frame 84 and ball bearings 94 (the frame and ball bearings are made of a ferrous metal) with sufficient force to overcome the force of the spring 95. As the frame 84 and ball bearings 94 move toward the magnet 12 and away from the top of tapered cover 80, the pinching force is relieved and the shaft 24 may be pulled out of the catch assembly 2 thereby detaching the pin assembly 1 from the catch assembly 2.

Turning then to FIGS. 5 and 19-22, the utility of the present invention will be further explained. As illustrated in FIG. 5, fabric 100 may be folded over and the layers 102 and 103 fastened together using a pin assembly 1 and catch assembly 2. As illustrated in FIGS. 19-22, two fabric items 104 and 105 may be coupled together using a pin assembly 1 and catch assembly 2. Multiple pin assemblies and catch assemblies may be so employed to achieve significant benefit.

One illustrative example is the joining of a duvet cover to a comforter. The comforter is first properly positioned within the duvet cover. The next step is to pass the shaft 24 of a pin assembly 1 through the duvet cover and comforter adjacent one of the corresponding corners of the duvet cover and comforter. The catch assembly 2 is then coupled to the pin assembly 1. These steps are then repeated for the other three corners. As such, each corner of the comforter is held to a corresponding corner of the duvet cover in two ways. First, the elongate shaft 24 helps hold a corner of the comforter and a corner of the duvet cover together since the elongate shaft 24 passes through both the comforter and duvet cover. Second, by squeezing the pin assembly 1 and catch assembly 2 together, the inward squeezing force between the bottom of the head 22 of the tack 20 for the flange 26) of the pin assembly 1 and the top of the cover 66 of the catch assembly 2 also helps hold the corner of the comforter to the corner of the duvet cover. This inward squeezing force prevents the shaft 24 from tearing or even ripping out of the fabric of the comforter or duvet cover. Pinching of the ball bearings 94 against the shaft 24 secures the pin assembly 1 and catch assembly 2 together. Decoupling of the pin assemblies 1 from the catch assemblies 2 is a simple task. All one need do is mate a catch assembly 2 with the release member 3. The magnet(s) of the release member loosens the grip of the ball bearings 94 on the shaft 24, permitting the pin assembly 1 to be pulled out and away from the catch assembly 2.

A broad range of uses exists for such couplings. As such, the foregoing should be understood as illustrative examples and not as limiting.

What is claimed is:

1. A fabric fastener comprising:

(a) a pin assembly including a head and a shaft projecting longitudinally from the head;

(b) a releasable catch including:

(i) a first housing having:

(1) a base having a bottom; and (2) a cover having a tapered side wall and a top having a hole therethrough, (ii) a frame including:

(1) a sidewall with three side openings extending through the side wall at 120 degree spacings thereabout;

(2) a spring collar; and (3) a longitudinal opening intersecting the three-side openings, (iii) at least three ball bearings adapted to move back and forth within the side openings; and (iv) a spring having a first end residing within the spring collar and a second end engaging the bottom of the base, wherein when the shaft is inserted through the hole of the top and longitudinal opening of the frame, the spring applies a force tending and to move the frame and ball bearings into the cover and toward the top of the cover such that the tapered side walls move the ball bearings inwardly toward the shaft with sufficient force to pinch the shaft and thereby hold the pin assembly and catch assembly together; and (c) a release member having a tubular housing with a closed end and an open and, the housing containing a permanent magnet recessed a predetermined distance from the open end and the open end sized to receive the base of the first housing therein only when the bottom of the base is inserted through the open and of the tubular housing, insertion of the base into the open end of the tubular housing serving to bring the frame and ball bearings into sufficiently close proximity to the magnet such that the force exerted by the magnet is sufficient to overcome a force of the spring and thereby move the frame away from the top of the cover to displace the ball bearings so that they no longer pinch the shaft with sufficient force to retain the shaft within the catch.

2. The fabric fastener of claim 1 wherein the pin assembly further comprises a flange.

3. The fabric fastener of claim 2 wherein the flange is integrally formed and has a top surface, a bottom surface, and an edge surface, the top surface and bottom surfaces cooperating to define a central flat portion having a first hole extending through the central flat portion between the top surface and the bottom surface, a first intermediate portion extending outwardly from the central flat portion to a boundary in a direction transversely toward and longitudinally away from the edge surface, and a second intermediate portion extending outwardly from the boundary in a direction which is both transversely and longitudinally toward the edge surface, wherein the central flat portion is positioned within a top recess and a bottom recess.

4. The fabric fastener of claim 2 wherein said flange is made of a transparent material.

5. The fabric fastener of claim 3 wherein said first intermediate portion has a frusto-conical shape and said second intermediate portion has a frusto-conical shape.

6. The fabric fastener of claim 1 wherein said catch further comprises an outer housing adapted to fit within the opening in the tubular housing of the release member.

7. The fabric fastener of claim 6 wherein the outer housing has a tapered portion which is adapted to be received within the opening of the housing of the release member.

8. The fabric fastener of claim 1 wherein the release member further includes a cover adapted for attachment to the tubular housing and thereby covering the open end of the tubular housing.

9. The fabric fastener of claim 1 wherein the release member include a clasp.

10. The fabric fastener of claim 1 wherein the pin is adapted to pass through a duvet cover and a comforter and mate with the catch such that the head of the pin is on a first side of the duvet cover and comforter and the catch is on a second side of the duvet cover and comforter.

11. A fabric fastening kit comprising:

(a) four fabric fasteners, each comprising:

(i) a pin assembly comprising a tack having a head and a shaft projecting longitudinally from the head; and (ii) a releasable catch comprising (1) a housing having a base and a cover, said cover having a bottom and said cover having a tapered side wall and a top, said top having a hole therethrough;

(2) a frame having a side wall with three equally circumferentially spaced side openings, a spring collar, and a longitudinal opening;

(3) a ball bearing placed within each of the side openings and sized to move therein; and (4) a spring having a first end residing within the spring collar and a second end engaging the bottom of the base of the housing;

wherein the shaft of the pin is insertable through the hole of the top and the longitudinal opening of the frame, and wherein the spring applies a force for urging the frame and ball bearings into the cover and toward the top of the cover whereby the tapered side walls of the housing force the ball bearings inwardly toward the shaft with sufficient force to pinch the shaft and thereby latch the pin assembly and catch assembly together; and (b) a release member having a tubular housing with a closed end and an open end, the housing containing a permanent magnet recessed a predetermined distance from the open end and the open end sized to receive the base of the first housing therein only when the bottom of the base is inserted through the open end of the tubular housing, insertion of the base into the open end of the tubular housing serving to bring the frame and ball bearings into sufficiently close proximity to the magnet such that the force exerted by the magnet is sufficient to overcome a force of the spring and thereby move the frame away from the top of the cover to displace the ball bearings so that they no longer pinch the shaft with sufficient force to retain the shaft within the catch.

12. The kit of claim 11 wherein said pin assembly further includes an integrally formed flange made of a transparent material.

13. The kit of claim 12 wherein said flange comprises a first frusto-conical shaped portion and a second frusto-conical shaped portion.

14. The kit of claim 11 wherein the catch has a flat engagement surface.

15. The kit of claim 11 wherein the catch includes an outer housing having a tapered portion.

16. The kit of claim 11 wherein the release member further includes a cap adapted for attachment to the open end of the tubular housing.

17. The kit of claim 16 wherein the cap includes a first set of threads and the tubular housing includes a second set of threads which cooperates with the first set of threads to couple the cap to the tubular housing.

18. The kit of claim 11 wherein the release member include a clasp.

19. The kit of claim 12 wherein the shaft of the tack is adapted to pass through a first fabric layer and a second fabric layer and mate with the catch such that the head of the tack and flange member are on a first side of the first fabric layer and second fabric layer and the catch is on a second side of the first and second fabric layers.

20. A fabric fastener comprising:

(a) a tack having a head and a shaft projecting from the head;

(b) a releasable catch that receives the shaft of the tack, the catch comprising a housing, a frame having a collar, at least three ball bearings, and a spring, wherein the frame has openings that receive the ball bearings and permit the ball bearings to move back and forth within the openings, wherein the frame can be made to move between a first locked position in which the ball bearings are pinched against the shaft by the housing thereby locking the tack and catch together and a second unlocking position, and wherein said spring has a first end residing within the collar and applies a spring force to the frame holding the frame in the first locked position; and (c) a release member having a second housing having an end with an opening and a magnet recessed from the end within the opening of the second housing end, wherein the opening of the second housing end receives and orients the first housing with respect to the magnet such that the magnetic force exerted by the magnet is of sufficient strength to overcome the force of the spring and move the frame from the first locked position to the second unlocked position permitting the tack to be separated from the catch.

* * * * *